United States Patent [19]

Lydiard

[11] 4,373,275

[45] Feb. 15, 1983

[54] FOOTWEAR

[75] Inventor: Graeme K. Lydiard, Auckland, New Zealand

[73] Assignee: Lydiard Shoe Co. Ltd., Auckland, New Zealand

[21] Appl. No.: 193,464

[22] Filed: Oct. 3, 1980

[30] Foreign Application Priority Data

Oct. 19, 1979 [NZ] New Zealand ..... 191885

[51] Int. Cl.[3] ..... A43B 5/00; A43B 23/26

[52] U.S. Cl. ..... 36/129; 36/54; 36/106; 36/110

[58] Field of Search ..... 36/106, 114, 54, 110, 36/129

[56] References Cited

U.S. PATENT DOCUMENTS

| | | | |
|---|---|---|---|
| 2,244,030 | 6/1941 | Teehan | 36/54 |
| 3,566,487 | 3/1971 | Beightol | 36/110 |
| 3,626,610 | 12/1971 | Dassler | 36/129 |

*Primary Examiner*—Patrick D. Lawson

[57] ABSTRACT

An athletic shoe is provided with an open-toe to facilitate cooling of the wearers' foot during running. The tongue of the shoe is attached to one side edge of the shoe.

1 Claim, 2 Drawing Figures

FOOTWEAR

This invention relates to footwear and in particular to an improved athletic shoe.

The intention of this invention is to provide an athletic shoe suitable for road use, in particular distance running, including training and recreational jogging designed to facilitate air circulation about a wearer's foot and thereby facilitate cooling thereof.

According to one aspect of this invention there is provided an athletic shoe including a sole with an upper attached thereto characterised in that the forward section of the upper terminates short of the toe of this sole so as to form an open toed shoe, the upper being fixed about the remainder of the periphery of the sole to form two lateral portions, the forward sections of which are adapted for lacing together to hold a wearers foot.

According to a further aspect, this invention provides an athletic shoe as described in the preceding paragraph and further including a tongue attached to one side of the shoe only.

Other aspects of this invention, which should be considered in all its novel aspects, will become apparent from the following description, which is given by way of example only, with reference to the accompanying drawings, in which.

Figure 1:
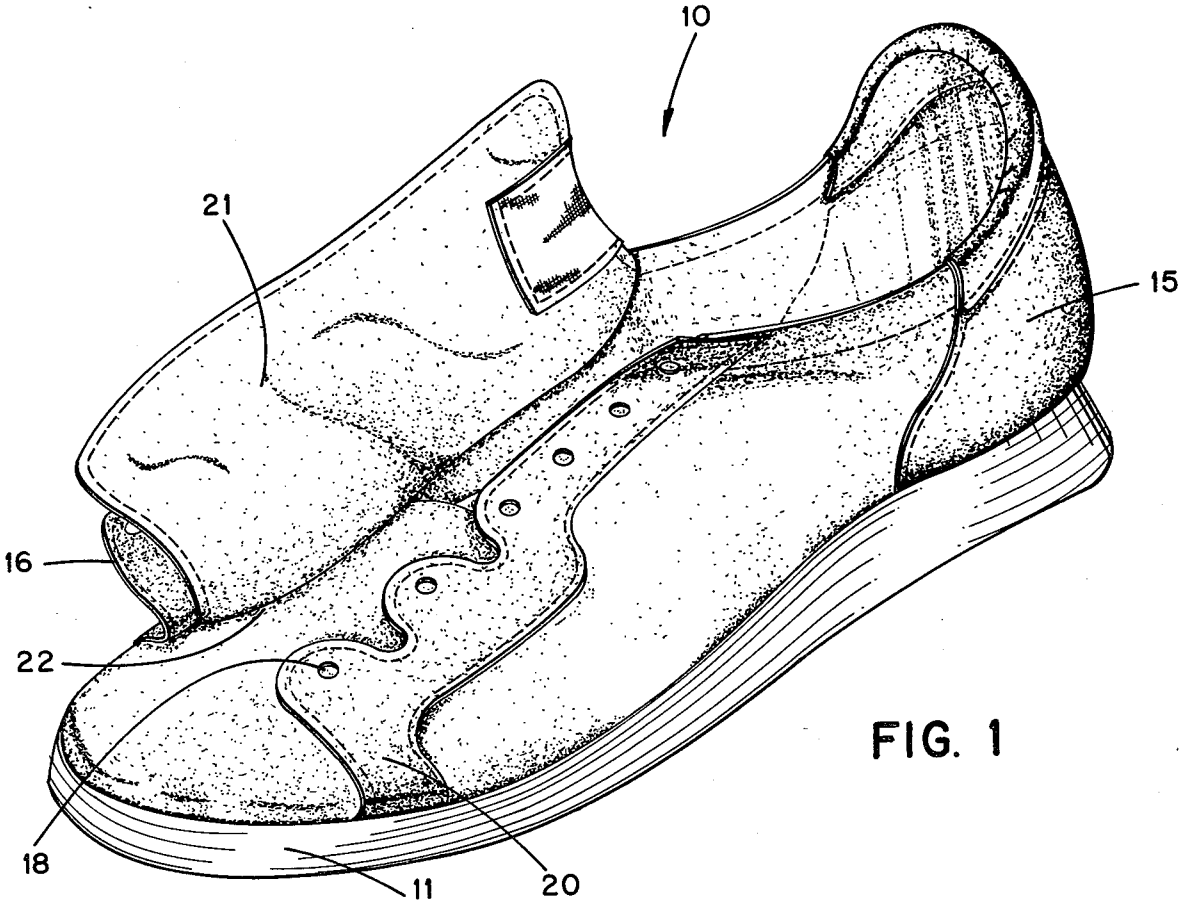
FIG. 1 illustrates a preferred athletic shoe having the laces removed to illustrate the attachment of the tongue.

A preferred shoe 10 has a moulded sole of known foam rubber construction forming the main body thereof with a lower wearing surface which may be provided with appropriate traction embellishments.

An upper 12 and an insole 13 are attached to the main sole 11 in known manner, such as by adhering thereto, with the insole 13 covering the complete upper face of the sole 11.

The upper 12 is cut to the required shape and is conveniently of layered composited construction incorporating inter alia a strengthened heel section 15. The upper is cut in such a fashion that in mounting it to the sole, the forward section thereof terminates short of the toe of the sole to thus form an open toed shoe. The upper 12 is fixed about the remainder of the periphery of the sole to form two lateral portions 16, 17 and joined by the heel 15.

The forward sections of the two portions of the upper are provided with lacing apertures 18 to receive a lace 19. These portions of the upper having the lacing apertures 18 are preferably reinforced as shown at 20.

Figure 2:
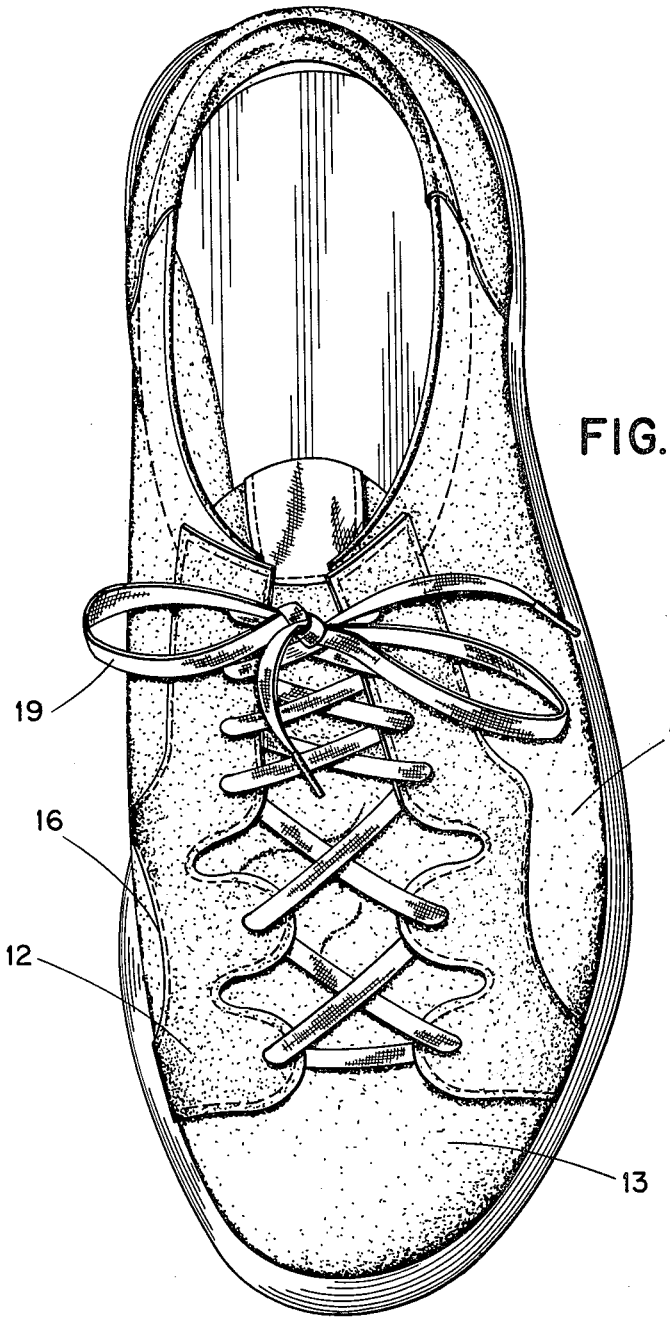
FIG. 2 illustrates a top plan view of the shoe of FIG. 1 when laced.

In producing shoes of different sizes, the upper, and in particular the forward lacing section thereof, is dimensioned such that with a conventional fit the free edges of the portions 16, 17 are spaced apart from one another as shown in FIG. 2. Such geometry provides that in fitting the shoe to a wearer's foot, lacing the upper forward sections 16, 17 together enables the shoe to be retained on the foot by the corset tight action of the laces. Thus the shoe readily accommodates feet of varying widths and/or instep heights as such arrangement enables considerable adjustment.

A tongue 21 is attached along one side of the shoe. As shown in FIG. 1, it is attached along edge 22 to the upper 16 adjacent to the junction of upper 16 with the sole. The tongue 21 is preferably of such a width as to fit beneath both upper portions 16, 17 when the shoe is laced as shown in FIG. 2. By attaching the tongue to the side of the shoe, whether to one of the upper portions, or to the sole, it does not inhibit the adjustment of the uppers and also does not impede movement of air into the front of the shoe.

Experiments have shown that the open toed construction of the preferred athletic shoe as illustrated in the drawings, facilitates cooling of the feet during road running, and thus minimises discomfort to the wearer.

Finally, it will be appreciated that various alterations and modifications may be made to the foregoing without departing from the scope of this invention as ememplified by the following claims.

I claim:

1. An athletic shoe, comprising a molded sole with an upper attached thereto characterized in that the forward section of the upper terminates short of the toe of the sole so as to form an opened toed shoe, the upper being affixed to the remainder of the sole to extend upwardly from the periphery thereof to form a heel portion joined to lateral portions, each lateral portion incorporating lace receiving apertures adjacently along an upper edge thereof save for a section thereof bordering the heel portion to thus define in conjunction with the heel portion an ankle opening, a tongue attached along a lateral edge section thereof to one of the lateral sections of the upper, adjacent the attachment of the upper to the sole, the tongue being arranged to be disposed on lacing of the shoe beneath both sections of the upper incorporating the lace apertures.

* * * * *